US007077048B1

(12) United States Patent
Anderson, Jr. et al.

(10) Patent No.: US 7,077,048 B1
(45) **Date of Patent: *Jul. 18, 2006**

(54) MULTI-LAYERED TRAP BALLISTIC ARMOR

(75) Inventors: Charles E. Anderson, Jr., San Antonio, TX (US); Dennis L. Orphal, 5274 Blackbird Dr., Pleasanton, CA (US) 94566; Gordon R. Johnson, Edina, MN (US)

(73) Assignees: Southwest Research Institute, San Antonio, TX (US); Alliant Techsystems Inc., Edina, MN (US); Dennis L. Orphal, Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/805,955

(22) Filed: Mar. 22, 2004

Related U.S. Application Data

(62) Division of application No. 09/887,298, filed on Jun. 22, 2001, now Pat. No. 6,718,861.

(51) Int. Cl.
*F41H 5/04* (2006.01)
*F41H 5/08* (2006.01)

(52) U.S. Cl. ..... 89/36.02; 89/36.05; 89/36.08; 2/2.5

(58) Field of Classification Search ..... 89/36.02, 89/36.05, 36.08; 2/2.5; 428/911
See application file for complete search history.

(56) References Cited

U.S. PATENT DOCUMENTS

| | | | | |
|---|---|---|---|---|
| 2,723,214 A | | 11/1955 | Meyer | 154/52.5 |
| 3,813,281 A | * | 5/1974 | Burgess et al. | 428/51 |
| 3,962,976 A | * | 6/1976 | Kelsey | 109/82 |
| 4,292,882 A | * | 10/1981 | Clausen | 89/36.02 |
| 4,648,136 A | | 3/1987 | Higuchi | 2/2.5 |
| 4,969,386 A | | 11/1990 | Sandstrom et al. | 89/36.02 |
| 5,060,553 A | * | 10/1991 | Jones | 89/36.02 |
| 5,196,252 A | | 3/1993 | Harpell | 428/102 |
| 5,456,156 A | | 10/1995 | Semple | 89/26.02 |
| 5,515,541 A | | 5/1996 | Sacks et al. | 2/2.5 |
| 5,738,925 A | | 4/1998 | Chaput | 428/101 |
| 5,776,839 A | * | 7/1998 | Dischler et al. | 442/239 |
| 5,804,757 A | | 9/1998 | Wynne | 89/36.05 |
| 5,866,839 A | | 2/1999 | Ohayon | 89/36.08 |

(Continued)

FOREIGN PATENT DOCUMENTS

| | | | |
|---|---|---|---|
| DE | 1127759 | 4/1962 | 89/36.02 |

(Continued)

OTHER PUBLICATIONS

Cipparrone, Gabriele, "Modification of the Perforation Mechanism in the Ballistic Impact on Alluminum Plates", Politecnico di Torino, Facoltá di Ingegneria, Corso di Laurea in Ingegneria Meccanica, pp. iii-ix; 1-59, Mar. 1999.

*Primary Examiner*—Stephen M. Johnson
(74) *Attorney, Agent, or Firm*—Baker Botts L.L.P.

(57) ABSTRACT

A momentum trap ballistic armor comprises an accelerating layer, a plug layer adjacent to the accelerating layer, and an energy absorbing layer. The plug layer includes an opening and at least one plug maintained within the opening. When a projectile impacts the accelerating layer, the plug is accelerated to the velocity of the projectile before the projectile perforates the plug, forming a projectile-plug combination. The energy absorbing layer is used to capture the projectile-plug combination. The accelerating layer is typically ceramic, the plug layer is typically metal, and the energy absorbing layer is typically ballistic cloth material.

24 Claims, 4 Drawing Sheets

U.S. PATENT DOCUMENTS

| | | | | |
|---|---|---|---|---|
| 5,976,656 | A * | 11/1999 | Giraud | 428/44 |
| 5,996,115 | A | 12/1999 | Mazelsky | 2/2.5 |
| 6,035,438 | A | 3/2000 | Neal et al. | 2/2.5 |
| 6,112,635 | A * | 9/2000 | Cohen | 89/36.02 |
| 6,203,908 | B1 * | 3/2001 | Cohen | 428/397 |

FOREIGN PATENT DOCUMENTS

| | | | |
|---|---|---|---|
| DE | 2703409 | 2/1987 | 89/36.02 |
| DE | 4114809 A1 | 11/1992 | |
| WO | 93/21492 | 10/1993 | |

* cited by examiner

MULTI-LAYERED TRAP BALLISTIC ARMOR

RELATED APPLICATIONS

This application is a Divisional of U.S. patent application Ser. No. 09/887,298, now U.S. Pat. No. 6,718,861, entitled "Momentum Trap Ballistic Armor System," filed by Charles E. Anderson Jr. et al. on Jun. 22, 2001.

GOVERNMENTAL RIGHTS

The U.S. Government has a paid-up license in this invention and the right in certain circumstances to require the patent owner to license others on reasonable terms as provided for by the terms of Contract No. DAAK60-97-C-9228 for the U.S. Army Soldiers System Command.

TECHNICAL FIELD OF THE INVENTION

This invention relates generally to the field of apparatus and systems for shielding personnel and other objects from hostile activity, including objects or projectiles fired from a gun or resulting from explosions. More particularly, this invention relates to an armoring system which operates to trap ballistic projectiles using a combination of layered components, including plugs.

BACKGROUND OF THE INVENTION

Many different approaches to the protection of personnel from life-threatening attacks exist. Examples include bullet-proof glass, concrete and steel building structures, armored cars, bullet-resistant jackets, and others. The particular avenue taken depends on whether the person to be protected is stationary, located in a vehicle, located within a building, or is required to maintain mobility outside the confines of any specific stationary structure.

For example, light-weight armor relies primarily on the strength and preferred placement of materials to defeat bullets or other projectiles. Thus, armor made of fabric material, such as nylon, aramids, or polyethylene, is designed to defeat lead-filled bullets, often called ball rounds. The conventional "bullet-proof" vest, however, cannot stop bullets that have hard cores. These types of bullets are often referred to as armor-piercing (AP) bullets. Currently, to defeat AP bullets, a layered structure element comprising a hard front face (e.g., ceramic) bonded to a metal or composite substrate element, is used. This combination of plates is inserted into pockets sewn into vests for body armor application. Alternatively, the combination of plates can consist of an integral element that has a shape somewhat conformable to the body. Such plates can also be attached to vehicles and other structures for protection of personnel.

Using the conventional multi-plate approach, material geometries and spacing between armor elements may be adjusted to induce ballistic projectiles to fracture and rotate about the incoming velocity vector. For example, one concept involves placing a multiplicity of holes within an armor element configuration. Given proper spacing between elements, the probability is great that an incoming projectile will strike the edge of a hole in the primary or first element, causing it to rotate before impacting the secondary or backup armor element. This approach requires a robust primary element so as to initiate rotation, and adequate air space between the primary and secondary elements to enable the projectile to rotate sufficiently before the second impact. Although effective as a system, it is difficult to decrease the weight of the primary element (while retaining performance), and a large air space is necessary between the primary element and the secondary element.

Lighter ceramics and improved substrate performance allow the production of reduced areal density elements, such that lighter armor can be produced to protect against a given threat. However, over the past twenty years, the decrease in areal density required to defeat AP threats has been incremental at best. New materials have resulted in small improvements in armor weight (i.e., areal density). To substantially reduce the weight of armor, including that worn by personnel, requires a significant decrease in areal density—much larger than that obtained to date.

SUMMARY OF THE INVENTION

As described above, some armor systems are designed to use the primary armor layer to initiate rotation, or "tumbling" about the incoming velocity vector of the projectile. Rotation of the ballistic projectile relies on the use of asymmetric force to initiate turning, and requires space between the initiating element and some type of backup element to provide time for the projectile to rotate. This "tumbling" action serves to increase the surface area of the projectile encountered by the backup armor element. In other armor systems, a ceramic-faced armor operates to blunt the point and shorten the length of an AP bullet through erosion, but it does not increase the overall presented area of the bullet.

The momentum trap ballistic armor system of the present invention makes use of a new mechanism to reduce the armor weight required to defeat AP threats and other ballistic projectiles. The system effectively increases the presented area of the projectile, which in turn increases the effectiveness of the secondary armor layer (or layers). In use, the system operates to combine an armor element with the projectile, effectively "trapping" the momentum of the bullet. The combination of the armor element and the projectile moves forward as a unit to encounter the secondary armor layer. The armor element carried along with the projectile is called a "plug." The secondary armor element is typically ballistic fabric, which is used to stop the bullet-plug combination.

Thus, the invention includes a momentum trap ballistic armor system which comprises an accelerating layer (typically ceramic) and a plug layer adjacent to the accelerating layer. The plug layer, in turn, includes at least one opening, with a plug maintained therein. Typically, a multiplicity of such openings and plugs are included in the plug layer. An energy absorbing layer (typically ballistic fabric) adjacent to the plug layer may also be included as part of the system.

The plug layer may be metallic, or make use of a composite. Plugs are usually maintained within the opening using an interference fit, adhesive, or some type of machined connection.

In an alternative embodiment, the momentum trap ballistic armor system comprises an accelerating layer, a plug layer adjacent to the accelerating layer, and an energy absorbing layer adjacent to the plug layer. In this case, the plug layer includes an opening and an attachment means for a releasable attachment of the plug from the opening. The attachment means may include an interference fit, adhesive, a grooved or machined fit, or some type of machined connection. As mentioned above, the energy absorbing layer may be some type of ballistic cloth, and the plug layer typically includes a multiplicity of openings wherein the attachment means is used for a releasable attachment of a corresponding multiplicity of plugs.

In another embodiment, the momentum trap ballistic armor system in the present invention may also be described as an accelerating layer, a plug layer adjacent to the accelerating layer, and an energy absorbing layer adjacent to the plug layer wherein the plug (included in the plug layer) accelerates to a speed approximately equal to the speed of a projectile upon impact. The acceleration of the plug is completed before the projectile perforates the plug so that a projectile-plug combination can be formed and captured by the energy absorbing layer. Typically, a portion of the accelerating layer is encapsulated by the plug at about the same time the projectile-plug combination is formed. The surface area of the plug is substantially the same as the surface area of the opening within the plug layer where it is maintained, and the plug surface area is usually substantially greater than the cross-sectional area of the projectile.

Finally, the momentum trap ballistic armor system may comprise an accelerating layer (typically ceramic) and a plug layer adjacent to the accelerating layer. The plug layer, in turn, includes a multiplicity of plugs attached or bonded to the accelerating layer. Each one of the multiplicity of plugs may also be bonded or attached to at least one other of the multiplicity of plugs. An energy absorbing layer (typically ballistic fabric) adjacent to the plug layer may also be included as part of the system.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION

Figure 1:
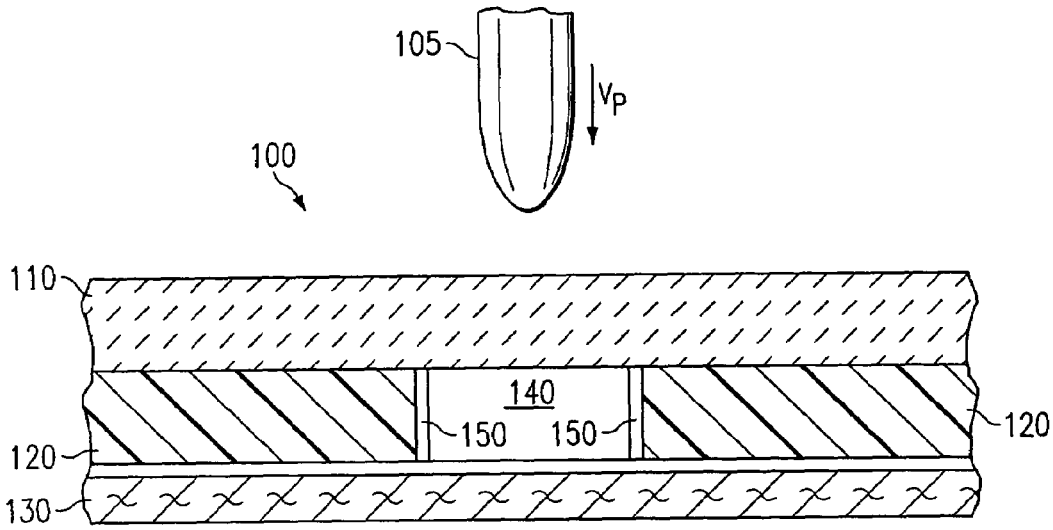
FIG. 1 is a side, cut-away view of the present invention before impact by a projectile.

Generally, the ballistic performance of protective materials, especially fabric, increases with the presented area of the projectile. FIG. 1 illustrates a side, cut-away view of the momentum trap ballistic armor system 100 of the present invention. In this case, a ballistic projectile 105 is traveling at a projectile velocity ($V_p$) toward the system 100, comprising an accelerating layer 110, a plug layer 120, and optionally, an energy absorbing layer 130. The energy absorbing layer 130 may form an integral part of the system 100, or exist as a separate element, such as a shirt worn under an armored vest.

Figure 2:
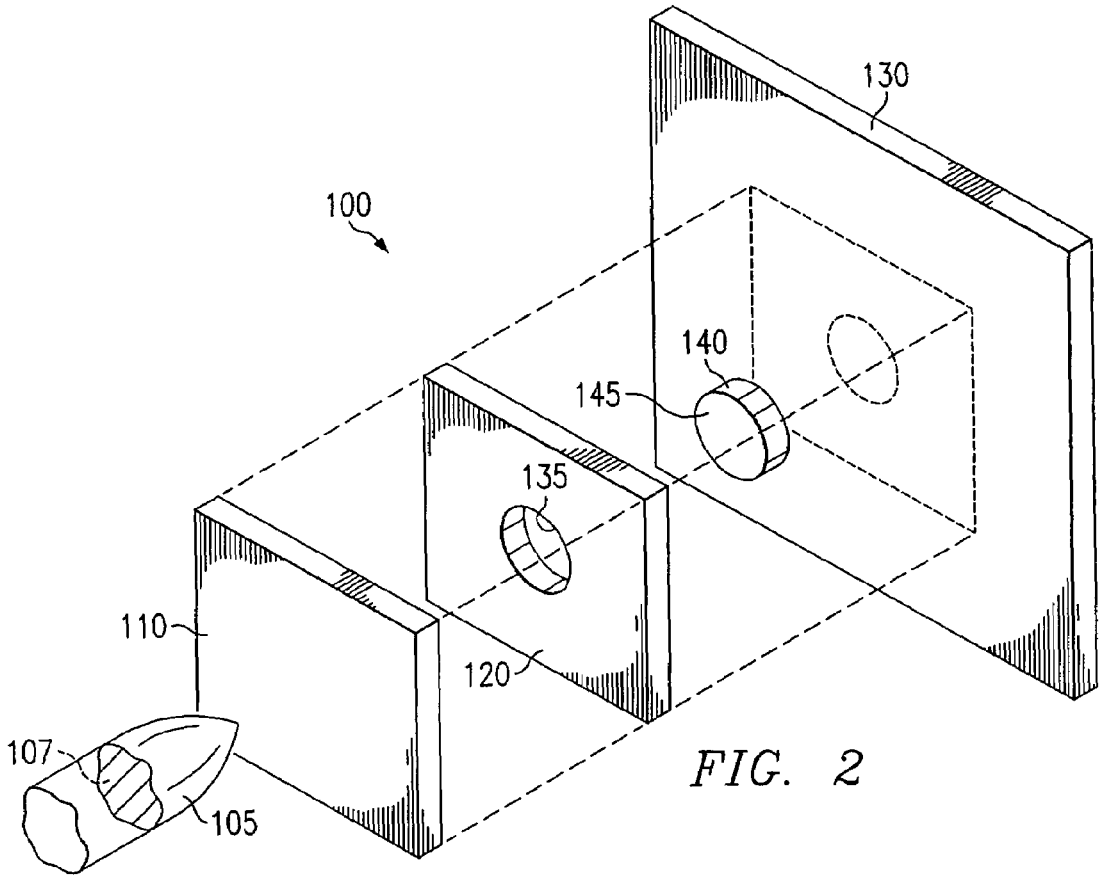
FIG. 2 is a perspective view of various elements which make up the momentum trap ballistic armor system of the present invention.
Figure 3:
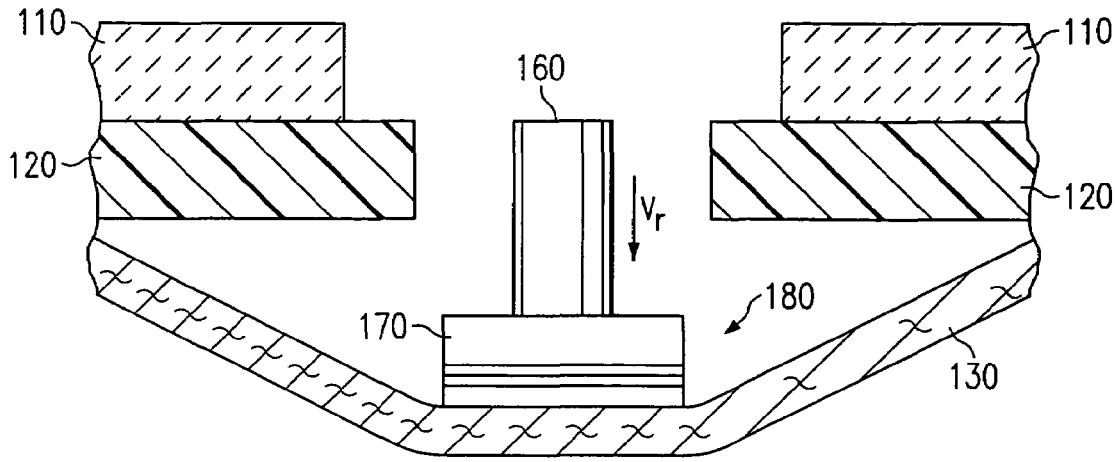
FIG. 3 is a side, cut-away view of the present invention after impact by a projectile.

FIG. 2 illustrates the elements of the momentum trap ballistic armor system 100 of the present invention. FIG. 3 illustrates the operation of the armor system to deform and reduce the velocity of the projectile 105. The mechanics associated with the armor system 100 can be thought of as a competition between the projectile 105 penetrating the plug 140 as it decelerates, while the plug 140 is simultaneously accelerated by the impact and penetration of the projectile 105. Correctly designed, the plug 140 accelerates to the projectile 105 velocity before the projectile 105 perforates the plug 140. Thus, the deformed projectile 160 (see FIG. 3) combines with a portion of the accelerating layer 110 and the plug 140 (together denoted as a deformed plug 170) to form a projectile-plug combination 180. When the projectile-plug combination 180 is formed, the energy absorbing layer 130 more easily stops the advance of the projectile 105.

It is important to note that a plug 140, attached to a plug layer 120, may be used to reduce the velocity of a projectile 105 without using an accelerating layer 110. However, at higher impact velocities, and for the plug thicknesses generally of interest for use with light-weight armor, the ceramic element is essential to the action of accelerating the plug 140 to the velocity of the projectile 105 before perforation of the plug 140 occurs.

Figure 4:
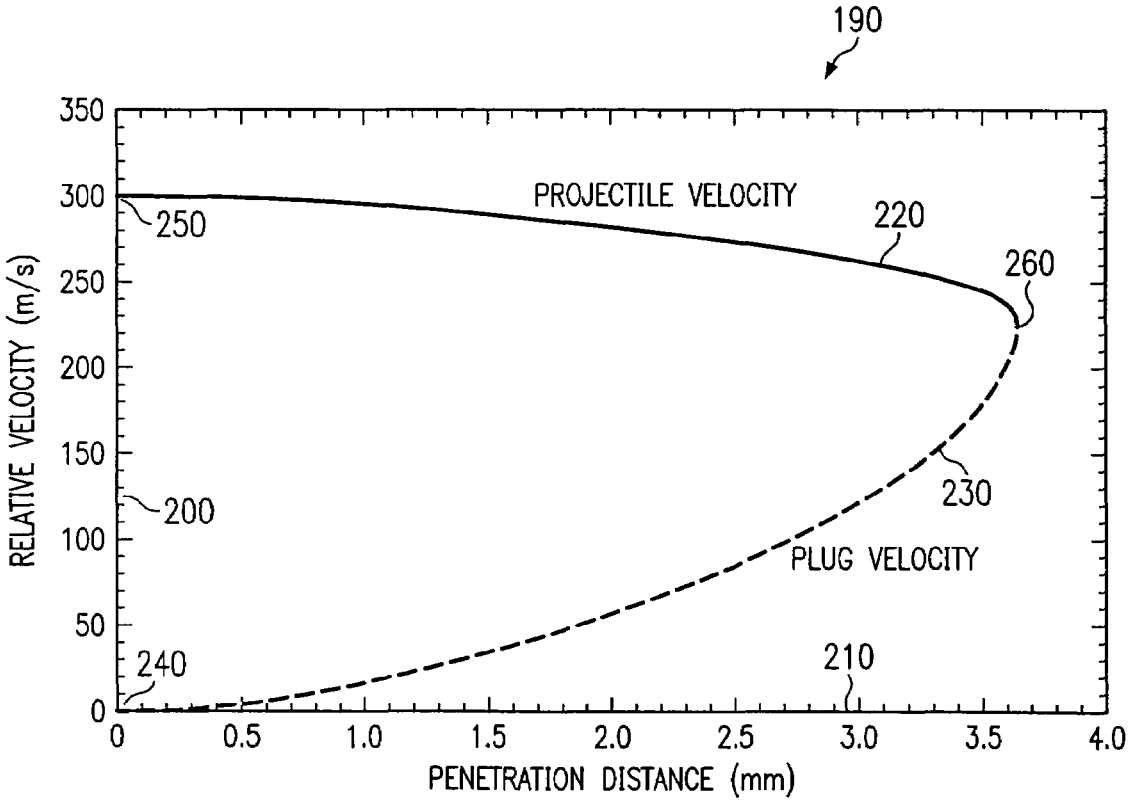
FIG. 4 is a graph of the relative projectile and plug velocities calculated from the time of projectile-plug interaction until the time of forming a projectile-plug combination.

FIG. 4 shows one example of a calculated relative velocity, at the time of impact of the projectile 105 on the plug 140, of the projectile 105 and plug 140 versus penetration distance into the plug. Stating it another way, the velocity axis 200 illustrates the relative velocity difference between the projectile 105 and the plug 140, i.e., after the projectile 105 has penetrated the accelerating layer 110, and goes on to encounter the plug 140. In this moving or relative velocity frame at the time of impact of the projectile 105 on the plug 140 the velocity of the plug 140 is 0 m/s and the velocity of the projectile 105 relative to the plug is 330 m/s 250. The penetration of the plug 140 by the projectile 105 reduces the velocity 220 of the projectile and increases the plug velocity 230 (relative to the constant velocity reference frame) until the projectile and plug achieve the same velocity 260 when the projectile 105 has penetrated the plug 140 a distance of about 3.6 mm forming a projectile-plug combination 180 with a relative velocity of about 230 m/s 260.

Typically, the cross-sectional area 107 of the projectile 105 is substantially less than the plug cross-sectional area 145. Laboratory demonstrations have shown effective operation of the system 100 when the ratio of the plug cross-sectional area 145 divided by the base area of the bullet (i.e., the projectile cross-sectional area 107), is about 4.0 to about 7.0. Of course, wider variations in the ratio can also be used effectively, depending upon the specific materials used to form the projectile 105, the plug 140, and the various layers 110, 120, and 130 of the system 100.

Figure 5:
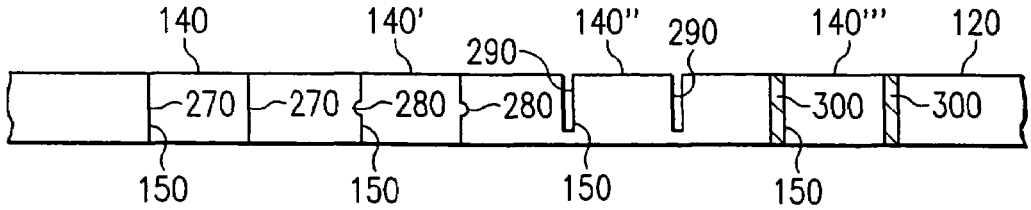
FIG. 5 is a side, cut-away view of the plug layer of the present invention.

FIG. 5 illustrates various options available for maintaining plugs 140 within the plug layer 120. In some embodiments, plugs 140 are attached within openings. The attachment means 150 include using a press-fit 270 between the plug 140 and the plug layer 120, a grooved fit 280 (wherein the geometry of the plug 140 and the plug layer 120 are varied along the edges of the opening 135 to provide greater friction than that available with a simple press-fit 270), a machined fit 290, wherein grooves are cut into the plug layer 120 so as to form a plug 140" or an adhesive fit 300, wherein a polymer or some other adhesive component is used to secure the plug 140''' to the plug layer 120. The notations 140', 140'', 140''' are used to denote similar or identical plug elements 140. In general, the plug layer 120 provides some means for generating plugs of a defined shape upon impact by a projectile.

Figure 6A:
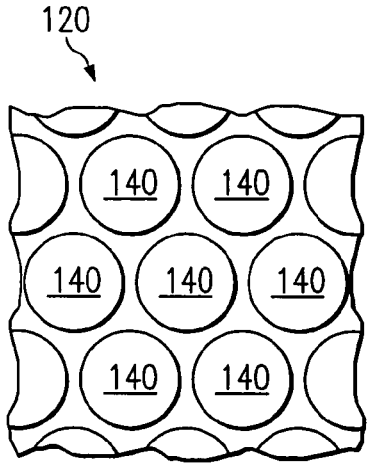
FIGS. 6A–6D are frontal views of various embodiments of the present invention.
Figure 6B:
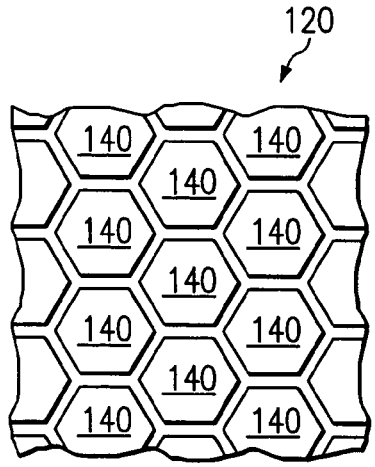
Figure 6C:
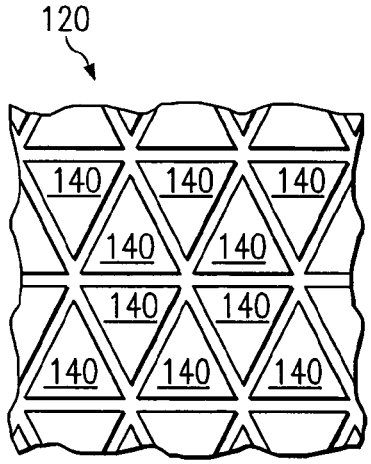
Figure 6D:
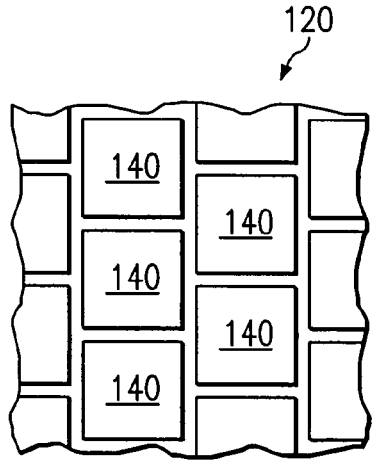

Not only does the invention accommodate several different attachment means 150, but the invention may also be effectively used with any number of different armor geometries. For example, as shown in FIG. 6A, a multiplicity of plugs 140 can be retained within a corresponding multiplicity of openings in the plug layer 120, wherein the plugs 140 are circular. FIGS. 6B, 6C, and 6D illustrate hexagonal, triangular, and rectangular/square geometries, respectively. Other geometries are obviously possible.

The accelerating layer 110 may be formed of many different materials and is typically chosen to be a ceramic, such as aluminum oxide, silicon carbide, aluminum nitride, or boron carbide. The accelerating layer 110 may be made of other ceramics or other materials well known to those skilled in the art.

Similarly, the plug layer 120 may comprise aluminum, titanium, steel, other metals, or a composite. The energy absorbing layer 130 may comprise a rigid material or a fabric material. Typically, the energy absorbing layer 130 is a ballistic fabric material, such as an aramid, an extended chain polyethylene, ballistic nylon, a group of silicon-coated nylon fibers, or a specialized polymeric fiber, such as poly(p-phenylene-2 benzobisoxazole) fiber. Also, such materials can be used in combination, such as combining a woven ballistic fabric and a non-woven fiber shield to construct the energy absorbing layer 130. Any material which is described as a polymeric fabric or fiber, or an ultra-high molecular weight polyethylene fabric or fiber, including aramids, polyethylenes, p-phenylene-2,6-benzobisoxazole, or any other flexible material or fiber of sufficient strength to resist puncture by the projectile-plug combination 180 can be used to fabricate the energy absorbing layer 130 of the present invention.

Experimental testing has demonstrated that the system 100 is effective to defeat an AP bullet fired from a rifle at point-blank range (e.g. at impact $V_p \approx 850$ meters/second). Applications include, but are not limited to, body armor for infantry soldiers and law enforcement agencies, integral armor or armor appliques for vehicles such as aircraft, helicopters, and cars. Other uses include military applications, such as used in conjunction with ground vehicles or amphibious assault vehicles. Thus, the system 100 for protection against a projectile 105 having a speed, or velocity $V_p$, comprises an accelerating layer 110, a plug layer 120, and (optionally) an energy absorbing layer 130. Typically, the plug layer 120 is planar to the accelerating layer 110 and the energy absorbing layer 130 is planar to the plug layer 120. The plug layer 120 includes at least one plug 140. These layers may be adjacent with perhaps an air gap between, but the same concepts could be applied to embodiments with intermediate layers. It is also possible to make the layers non-planar, such as for conforming or conformable clothing or other armoring.

During operation, the plug 140, which is maintained within an opening 135 in the plug layer 120, (or releasably attached to the opening 135 using an attachment means 150) accelerates to a speed approximately equal to the speed of the projectile 105 upon impact by the projectile 105, before the projectile perforates the plug 140, so that a projectile-plug combination 180 is formed. The projectile-plug combination 180, including the projectile 105 and the plug 140, can then be captured by the energy absorbing layer 130.

Figure 7A:
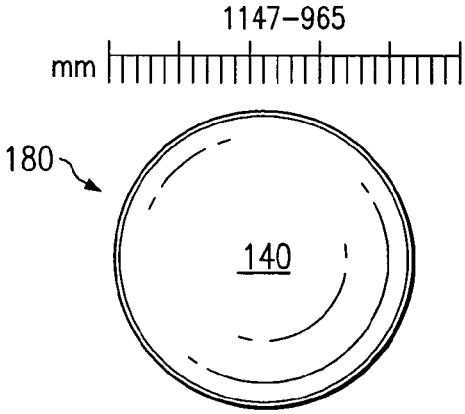
FIGS. 7A and 7B show the front face (i.e., side of the plug which impacts the energy absorbing layer) of the projectile-plug combination, and the rear face of the projectile-plug combination, respectively, as recovered after a test of the present invention.
Figure 7B:
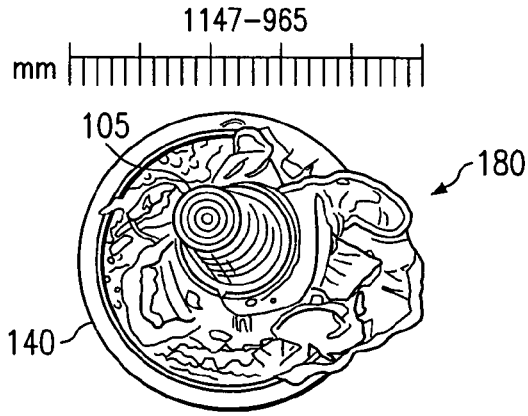

The projectile-plug combination can be seen in FIG. 7A, which illustrates the surface of the projectile-plug combination 180 which impacts the energy absorbing layer 130, and in FIG. 7B, where the projectile 105 is shown embedded in the plug 140 (i.e., the other side of the projectile-plug combination 180 shown in FIG. 7A.

A portion of the accelerating layer 110 may be carried along with the projectile-plug combination 180.

As noted previously, the use of an accelerating layer 110 ensures proper operation of the system 100 for light-weight armor as the velocities of impacting projectiles 105 increase. The accelerating layer 110 is responsible for accelerating the plug 140 to a sufficiently high velocity that the projectile-plug combination 180 is properly formed. The resulting projectile-plug combination 180 has a projected area significantly larger than that of the base projectile 105. Thus, the invention 100 serves to effectively increase the presented cross-sectional area of the projectile 105, such that the energy absorbing layer 130 is able to defeat the projectile 105 traveling at conventional AP impact velocities, which can be 850 m/sec or more. Thus, the system 100 enables energy absorbing layers 130 of ballistic fabric, or other materials, to stop projectiles 105 when such energy absorbing layers 130 would otherwise be unable to effectively reduce the velocity of the projectile 105 by a significant amount.

Typically, the system 100 of the invention incorporates multiple target elements (plugs 140) within body armor, or armor for various vehicles. The inventive concept is scaleable, such that the size of the plugs 140 can be changed to accommodate various calibers and velocities of projectiles. The concept can be applied to both ball rounds and AP bullets.

The geometry of the plugs 140 can be circular, square, rectangular, hexagonal, or triangular. Of course, the shapes are not limited to these alone, but may be dictated by other concerns well known to those skilled in the art. A multiplicity of plugs may be assembled together, retained in a single plug layer 120, or held together by an adhesive, a polymer matrix, or some other appropriate means.

Figure 8A:
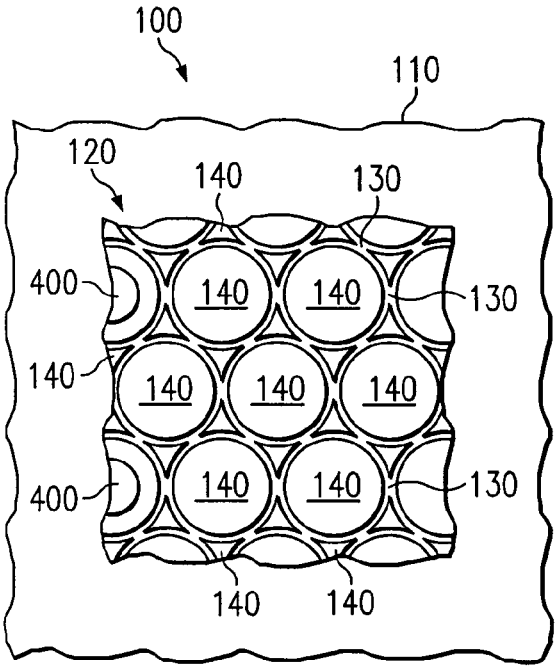
FIGS. 8A–8D are frontal views of alternative embodiments of the present invention.
Figure 8B:
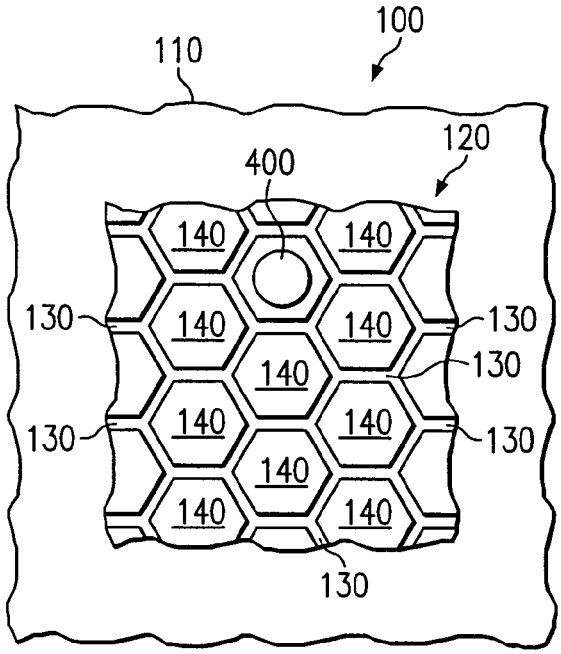
Figure 8C:
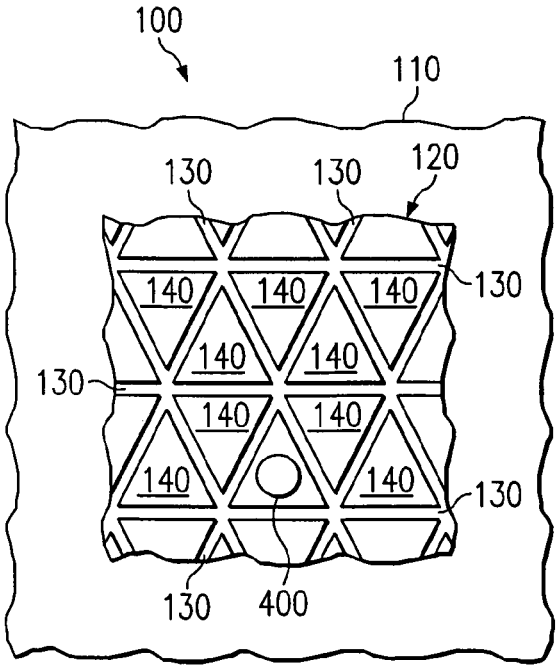
Figure 8D:
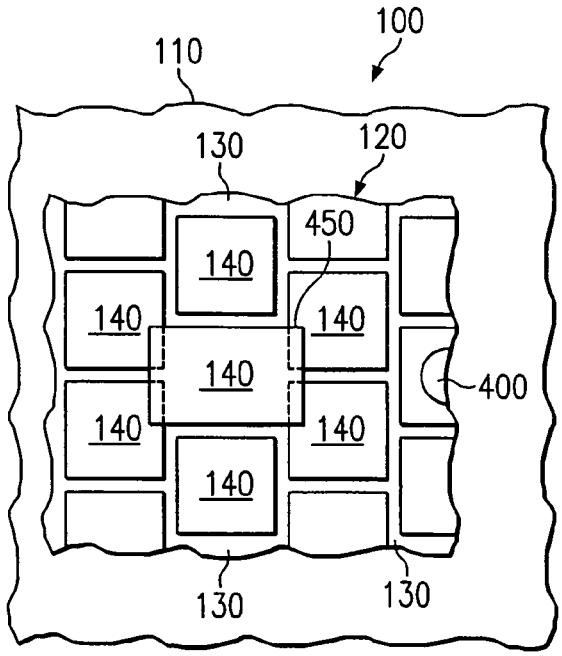

This concept is further illustrated in FIGS. 8A–8D. The armor system 100 of the present invention may also be embodied by an accelerating layer 110 (typically ceramic) and a plug layer 120 which includes a multiplicity of plugs 140, adjacent to the accelerating layer 110. Optionally, an energy absorbing layer 130 (typically ballistic fabric) may be laid adjacent to the plug layer 120 as a part of the system 100. In FIG. 8A, the plugs 140 can be formed into various complimentary geometric shapes so as to form a semi-continuous surface area prior to impact by a bullet. In this particular illustration, the plugs 140 are circular and quasi-triangular. The plugs 140 are attached or bonded to the accelerating layer 110, possibly using adhesive 400, or some other attachment means, such as chemical bonding. The plugs 140 may also be bonded or attached to each other. Of course, as noted in FIGS. 8B–8D, the plugs 140 may take on all kinds of complimentary geometric shapes, with the desired results being the formation of a semi-continuous plug layer for presentation to a bullet. As shown in FIG. 8D, the plugs 140 may form overlapping element 450 to reduce the likelihood of three-point hits, and other undesired effects of non-continuous armored protection. As mentioned previously, the plugs 140 may be attached to each other or the accelerating layer using mechanical (e.g. hinges) or chemical (e.g. adhesive) means. Ultrasonic or laser weld bonding may also be used.

Although the invention has been described with reference to specific embodiments, this description is not meant to be construed in a limited sense. Various modifications of the disclosed embodiments, as well as alternative embodiments of the inventions, will become apparent to persons skilled in the art upon the reference to the description of the invention. It is, therefore, contemplated that the appended claims will cover such modifications that fall within the scope of the invention.

What is claimed is:

1. A multi-layered armor for protecting a target against a projectile having a projectile velocity directed at the target, comprising:

an outer accelerating layer;

a plug layer adjacent the accelerating layer, the plug layer having an array of plugs; and an energy absorbing layer adjacent to the plug layer;

wherein the accelerating layer is operable to initially receive the impact of the projectile, and to accelerate at least one plug of the array of plugs such that the plug thereby accelerated is in motion before the projectile strikes the plug;

wherein the plugs are made from a material different from the accelerating layer and after any plug is impacted by the projectile, that plug is operable to obtain the velocity of the projectile before the projectile perforates the plug;

wherein a projectile-plug combination is formed before the projectile perforates the plug, such that the projectile-plug combination increases the presented area of impact to an area greater than that of the projectile when the projectile-plug combination reaches the energy absorbing layer.

2. The armor of claim 1, wherein the plug layer includes an opening having a surface area, wherein the plug has a surface area, and wherein the surface area of the plug is substantially the same as the surface area of the opening.

3. The armor of claim 1, wherein the projectile has a cross-sectional area, and wherein the plug has a cross-sectional area which is greater than the projectile cross-sectional area.

4. The armor of claim 1, where the accelerating layer and the plug layer are adjacent but spaced apart by an air gap.

5. The armor of claim 1, wherein at least one of the layers is planar.

6. The armor of claim 1, wherein at least one of the layers is non-planar.

7. The armor of claim 1, wherein at least one of the layers conforms to a surface of the target.

8. The armor of claim 1, wherein at least one layer is made from a flexible material.

9. The armor of claim 1, wherein at least one layer is made from a rigid material.

10. The armor of claim 1, wherein the layers are fabricated in sheet form with all layers planar to each other.

11. The armor of claim 1, wherein the plugs are made from a metallic material.

12. he armor of claim 1, wherein the plugs are made from a composite material.

13. The armor of claim 1, wherein the plug layer is fabricated as a matrix of plug openings with a plug attached in each opening.

14. The armor of claim 1, wherein the plug layer is fabricated as a matrix of plug openings and the ratio of the plug area to the cross sectional area of the projectile is substantially 4.0 to 7.0.

15. The armor of claim 1, wherein the plugs are attached to the back of the accelerating layer.

16. The armor of claim 1, wherein the accelerating layer is made from a ceramic material.

17. The armor of claim 16, wherein the ceramic is selected from a group consisting of aluminum oxide, silicon carbide, aluminum nitride, titanium diboride, tungsten carbide, and boron carbide.

18. The armor of claim 1, wherein the energy absorbing layer is a rigid material.

19. The armor of claim 1, wherein the energy absorbing layer is a flexible material.

20. The armor of claim 1, wherein the energy absorbing layer is a fabric material.

21. The armor of claim 1, wherein the energy absorbing layer is made from a ballistic fabric.

22. The armor of claim 1, wherein the energy absorbing layer is an aramid material.

23. The armor of claim 1, wherein the energy absorbing layer is a polyethylene material.

24. The armor of claim 1, wherein the energy absorbing layer is made from a polymeric fiber material.

* * * * *

UNITED STATES PATENT AND TRADEMARK OFFICE

CERTIFICATE OF CORRECTION

PATENT NO. : 7,077,048 B1
APPLICATION NO. : 10/805955
DATED : July 18, 2006
INVENTOR(S) : Charles E. Anderson, Jr., Dennis L. Orphal and Gordon R. Johnson It is certified that error appears in the above-identified patent and that said Letters Patent is hereby corrected as shown below:

Face page [54] Title: Please correct the title by deleting [Multi-Layered Trap Ballistic Armor] and replace with --"Multi-Layered Momentum Trap Ballistic Armor" -- and Face page [73] Assignee: Please correct the spelling of the first Assignee listed by deleting [Southwest Research Institude] and replace with --"Southwest Research Institute"--

Signed and Sealed this

Twenty-first Day of November, 2006

JON W. DUDAS
*Director of the United States Patent and Trademark Office*